US005529972A

United States Patent [19]

Ramello et al.

[11] Patent Number: 5,529,972

[45] Date of Patent: Jun. 25, 1996

[54] THERMAL DYE TRANSFER RECEPTORS

[75] Inventors: Piero Ramello, Moncalieri; Adriano Gribaudo, Carcare, both of Italy

[73] Assignee: Minnesota Mining and Manufacturing Company, St. Paul, Minn.

[21] Appl. No.: 958,040

[22] Filed: Oct. 7, 1992

[30] Foreign Application Priority Data

| | | | |
|---|---|---|---|
| Oct. 4, 1991 | [IT] | Italy | MI91A2647 |
| Oct. 21, 1991 | [IT] | Italy | MI91A2771 |
| Oct. 28, 1991 | [IT] | Italy | MI91A2852 |
| Feb. 13, 1992 | [IT] | Italy | MI92A0298 |

[51] Int. Cl.[6] ..... B41M 5/035; B41M 5/38

[52] U.S. Cl. ..... 503/227; 428/195; 428/211; 428/215; 428/216; 428/327; 428/334; 428/335; 428/336; 428/337; 428/409; 428/423.1; 428/480; 428/500; 428/522; 428/913; 428/914

[58] Field of Search ..... 8/471; 428/195, 428/500, 913, 914, 211–213, 215, 216, 327, 334–337, 409, 423.1, 480, 522; 503/227

[56] References Cited

U.S. PATENT DOCUMENTS

| | | | |
|---|---|---|---|
| 4,639,751 | 1/1987 | Mori et al. | 503/227 |
| 4,962,080 | 10/1990 | Watanabe | 503/227 |
| 5,071,823 | 12/1991 | Matsushita et al. | 503/227 |
| 5,202,205 | 4/1993 | Malhota | 430/17 |

FOREIGN PATENT DOCUMENTS

| | | | |
|---|---|---|---|
| 0300505 | 1/1989 | European Pat. Off. | 503/227 |
| 0351075 | 1/1990 | European Pat. Off. | 503/227 |
| 0363989 | 4/1990 | European Pat. Off. | 503/227 |
| 0364900 | 4/1990 | European Pat. Off. | 503/227 |
| 57-137191 | 8/1982 | Japan | 503/227 |
| 60-038192 | 2/1985 | Japan | 503/227 |
| 61-266296 | 11/1986 | Japan | 503/227 |
| 62-146693 | 6/1987 | Japan | 503/227 |
| 62-238790 | 10/1987 | Japan | 503/227 |
| 63-011392 | 1/1988 | Japan | 503/227 |
| 63-315283 | 12/1988 | Japan | 503/227 |
| 01004391 | 1/1989 | Japan | 503/227 |
| 01038277 | 2/1989 | Japan | 503/227 |
| 02025393 | 1/1990 | Japan | 503/227 |

*Primary Examiner*—B. Hamilton Hess
*Attorney, Agent, or Firm*—Gary L. Griswold; Walter N. Kirn; Mark A. Litman

[57] ABSTRACT

The present invention relates to a thermal dye transfer material, more specifically to a thermal dye transfer receiving material comprising a support having thereon at least one dye receiving layer which can accept a dye which migrates from a thermal dye transfer donating material as a result of heating, wherein said dye receiving material is obtained by coating an aqueous microdispersion (latex) of a dye accepting polymeric compound.

29 Claims, No Drawings

THERMAL DYE TRANSFER RECEPTORS

FIELD OF THE INVENTION

The present invention relates to thermal dye transfer materials, more particularly to thermal dye transfer receiving materials comprising a support having thereon at least one dye receiving layer.

BACKGROUND OF THE INVENTION

Various information processing systems have been developed as a result of the rapid changes which have taken place in the information industry in recent years. Methods of recording and apparatus compatible with new information processing systems have been developed and adopted. Thermal transfer recording methods use apparatus which is light and compact, has little noise, and has excellent operability and maintenance characteristics. Moreover, since thermal transfer also allow coloring to be achieved easily, these methods are widely used.

Thermal transfer recording methods can be broadly classified into two types, namely mass transfer types and dye transfer types. The latter case relates to a recording method in which a thermal dye transfer donating material (hereinbelow, "dye-donor") is constucted of a substrate with a dye layer containing dyes having heat transferability. The material is brought into contact with a thermal dye transfer receiving material (hereinbelow, "dye receptor"). The dye donor material is selectively heated with a thermal printing head provided with a plurality of juxtaposed heat-generating resistors. The heating is in response to an information signal defining a pattern or image. Dye from the selectively heated regions of the dye donor is transferred to the dye receptor and forms a pattern thereon. The shape and the density of the patern forms an image in accordance with the pattern and the intensity of heat applied to the dye-donor.

A dye receptor usually comprises a support coated with a dye receiving layer. The dye coming from the dye donor can thermally and properly diffuse into that layer. An intermediate layer, useful as cushioning layer, porous layer or dye diffusion preventing layer, may be provided between the support and the receiving layer.

The dye donor may be a monochrome dye layer or it may comprise a sequence of different colored and discrete areas of, for example, cyan, magenta, yellow, and optionally black hue. When a dye-donor containing said sequenced two, three or more primary color areas is used, a multicolor image can be obtained by sequentially performing the dye transfer process steps for each color. The dye receptors of the prior art are commonly manufactured by coating organic solvent solutions of polymers and other ingredients, involving expensive, polluting and hazardous processes. To reduce risks of fire, explosions and other accidents, special precautions and expensive manufacturing apparatus are needed in handling the organic solvent solutions used in that type of manufacture.

The image fastness given by the prior art dye receptors is quite limited and still not competitive with conventional photographic image fastness.

To bypass the use of organic solvents, JP Patent Appls. 57/137,191 or 60/038,192 claims dye receptors obtained by coating a blend of polyesters or vinylic latices that however still give the disadvantage of limited image fastness, including significant photofading.

European Appl. 363,989 describes dye receptors based on water soluble polymers in which polymeric dye accepting compounds are dispersed, and wherein said water soluble polymers are hardened by a hardening agent.

Similarly, JP Patent Appl. 02/025,393 describes dye receptors based primarily on polymer solutions as a primary binder and vinyl styrene or ethylvinylacrylate particles as a secondary ingredient.

EP 351,075 is another prior art example of aqueous dye receptors, using a silica dispersion and a melamine and formaldehyde condensation resin. In EP 300,505 a polyolefin latex is used to coat a receptor underlayer. The dye receiving layer is obtained by coating an organic solvent solution of polymer.

In JP Patent Appl. 61/266,296, aqueous receptors are obtained by using aqueous solutions of water soluble polymers such as polyvinyl alcohol or substituted celluloses as a binder for porous and non-porous fillers.

In JP Patent Appl. 63/315,283, aqueous solutions of polyvinyl alcohol and/or other water soluble resins are used as receptor binders. In EP 364,900 a polyester receptor layer is obtained by polycondensation of polyfunctional acids and alcohols and curing of the aqueous coated solution of reactants to crosslink them.

In DE 3,934,014 copolymers of styrene and acrylic compounds are used as latices for obtaining the underlayer. The dye receiving layer is coated over the latex underlayer.

JP 02/122,992 discloses a receiving layer comprising an aqueous solution or dispersion of polymeric resin in combination with silica particle and modified silicone oil, the layer having improved antisticking properties.

JP 01/038,277 discloses a composition for a receiving layer obtained from an aqueous dispersion of modified polyester containing hydrophilic groups.

In JP 01/004,391 aqueous latices with a Tg>50° C. are involved in the preparation of dye receptors in combination with colloidal silica.

JP 63/011,392 discloses an oil solution of resin dispersed in water and then coated.

In JP 62/238,790 a solution or dispersion of polyester having solubilizing groups is combined with a water solution or dispersion of resins and of crosslinking compounds to increase the adhesion of the receiving layer.

In JP 62/146,693 a latex is coated as an underlayer (cushioning layer) on which the receiving layer is coated.

Accordingly, there is at present continuous work to obtain aqueous dye receptors with improved qualities which reduce the above mentioned problems.

SUMMARY OF THE INVENTION

The present invention relates to a process for generating a multicolor image by thermal dye transfer comprising the steps of:

a) providing a thermal dye transfer donor sheet comprising substrate with a thermally transferable dye on one surface of said substrate, b) providing a thermal dye transfer receptor sheet having a substrate with at least one dye receiving layer, c) positioning the surface of the thermal dye transfer donor having a thermally transferable dye thereon with that surface in contact with the at least one dye receiving layer of the thermal dye transfer receptor, d) heating said thermal dye transfer donor sheet in an imagewise manner to transfer dye from the donor sheet to said at least one dye receiving layer, and e) repeating step a), b), c) and d) for each dye to be imagewise printed, wherein the dye receiving layer comprises a latex selected from the group consisting of polyurethane latices, styrene-butadiene latices, polyvinylacetoversatate latices, and styrene-acrylic latices.

In another aspect the present invention relates to a thermal dye transfer material comprising a thermal dye transfer donor having at least one dye donating layer comprising a thermomobile dye (e.g., thermally diffusible or sublimable) dispersed in a binder and a thermal dye transfer receptor which can be imagewise printed with dyes which migrate from said thermal dye transfer donor by means of heating, comprising a support and at least one dye receiving layer coated on at least one side of said support, said at least one dye receiving layer being in contact with said dye donating layer, and comprising a dye-accepting polymer latex selected from the group consisting of polyurethane latices, styrene-butadiene latices, polyvinylacetoversatate latices, and styrene-acrylic latices.

In a third aspect, the present invention relates to an image bearing dye receptor comprising a substrate having on at least one surface thereof a dye receiving layer having at least two different dyes adhered to said layer, each of said two dyes being distributed over said layer in an imagewise, non-continuous manner, wherein the dye receiving layer comprises a latex selected from the group consisting of polyurethane latices, styrene-butadiene latices, polyvinylacetoversatale latices, and styrene-acrylic latices.

In a further aspect the present invention relates to a thermal dye transfer receptor which can be imagewise printed with dyes which migrate from a thermal dye transfer donor by means of heating. The transfer receptor comprises a support and at least one dye receiving layer coated on at least one side of said support, the dye receiving layer comprising a dye accepting polymeric latex, wherein said dye accepting polymeric latex is selected from the group consisting of polyurethane latices, styrene-butadiene latices, polyvinylacetoversatate latices, and styrene-acrylic latices having a Tg lower than 50° C.

DETAILED DESCRIPTION OF THE INVENTION

The present invention relates to a thermal dye transfer receptor which can be imagewise printed with dyes which migrate from a thermal dye transfer donor by means of heating, the receptor comprising a support and at least one dye receiving layer coated on at least one side of said support. The dye receiving layer(s) comprises a dye accepting polymeric latex, wherein the dye-accepting polymeric latex is selected from the group consisting of polyurethane latices, styrene-butadiene latices, polyvinylacetoversatate latices, and styrene-acrylic latices having a Tg lower than 50° C.

Polyurethane compounds have been known since the discovery in 1937 of diisocyanate addition polymerization. The term polyurethane compound does not mean a polymer that only contains urethane groups, but means all those polymers which contain significant numbers of urethane groups, regardless of what the rest of the molecule may be. Homopolymers of isocyanates are usually referred to as isocyanate polymers. Usually polyurethane compounds are obtained by the reaction of polyisocyanates with polyhydroxy compounds, such as polyether polyols, polyester polyols, castor oils, or glycols, but compounds containing free hydrogen groups such as amine and carboxyl groups may also be used. Thus a typical polyurethane compound may contain, in addition to urethane groups, aliphatic and aromatic hydrocarbon residues, ester groups, ether groups, amide groups, urea groups, and the like. The urethane group has the following characteristic structure:

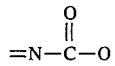

and polyurethane compounds have a significant number of these groups, although they do not necessarily repeat in a regular order. The most common method of forming polyurethane compounds is by the reaction of di- or polyfunctional hydroxy compounds, such as hydroxyl-containing (e.g., terminated) polyesters or polyethers, with di- or polyfunctional isocyanates. Examples of useful diisocyanates are represented by the following formula:

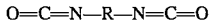

wherein R can be an organic group such as those represented by substituted or unsubstituted alkylene, cycloalkylene, arylene, alkylenebisarylene, arylenebisalkylene, etc. Examples of disocyanates within the formula above are 2,4-tolylene diisocyanate, 2,6-tolylene diisocyanate, 4,4'-diphenylmethane diisocyanate, dianisidine diisocyanate, tolidine diisocyanate, naphthylene diisocyanate, hexamethylene diisocyanate, m-xylydene diisocyanate, pyrene diisocyanate, isophorone diisocyanate, ethylene diisocyanate, propylene diisocyanate, octadecylene diisocyanate, methylenebis(4-cyclohexyl isocyanate) and the like.

Examples of di- or polyfunctional hydroxy compounds are hydroxyl-containing polyethers and polyesters having a molecular weight of from about 200 to 20,000, preferably of from about 300 to 10,000. Most of the polyethers used for the manufacture of polyurethanes are derived from polyols and/or poly(oxyalkylene) derivatives thereof. Examples of useful polyols include: 1) diols such as alkylene diols of 2–10 carbon atoms, arylene diols such as hydroquinone, and polyether diols [$HO(RO)_nH$] where R is alkylene, 2) triols such as glycerol, trimethylol propane, 1,2,6-hexanetriol, 3) tetraols such as pentaerythritol, and 4) higher polyols such as sorbitol, mannitol, and the like. Examples of polyesters used for the manufacture of polyurethanes are saturated polyesters having terminal hydroxy groups, low acid number and low water content, derived from adipic acid, phthalic anhydride, ethylene glycol, propylene glycol, 1,3-butylene glycol, 1,4-butylene glycol, diethylene glycol, 1,2,6-hexanetriol, trimethylolpropane, trimethylolethane, and the like. Other desirable polyols include castor oil (a mixture of esters of glycerol and fatty acids, the most relevant thereof is the ricinoleic acid), lactones having end hydroxyl groups (such as polycaprolactone), and block copolymers of propylene and or ethylene oxide copolymerizered with ethylenediamine.

Polyurethane latices are well-known in the art. Useful polyurethane latices are disclosed, for example, in U.S. Pat. Nos. 2,968,575, 3,213,049, 3,294,724, 3,565,844, 3,388,087, 3,479,310 and 3,873,484.

Useful polyurethane latices are neutral or they are anionically or cationically stabilized. Anionically or cationically stabilized latices are formed by incorporating charged groups into the polyurethane. Useful groups which impart a negative charge to the latex include carboxylate, sulfonate and the like. Useful repeating units are derived from polyol monomers containing these acidic functional groups such as 2,2-bis(hydroxymethyl)propionic acid, N,N-bis(2-hydroxyethyl)glycine and the like. Useful groups which impart a positive charge to the latex include quaternized amines, sulfonium salts, phosphinates and the like. Useful repeating units are derived from polyol monomers containing a tertiary amine or thio-functional group such as N-methyldiethanolamine, 2,2'-thioethanol and the like. Useful examples of anionically and cationically stabilized polyurethane latices are disclosed in U.S. Pat. Nos. 3,479,710 and 3,873,484.

The styrene-butadiene copolymers useful in the present invention are the products of copolymerization of styrene and butadiene. These copolymers contain a preponderance of butadiene, in particular of from 55% to 80% by weight, preferably of from 65% to 75% by weight of butadiene and a minor amount of styrene, in particular of from 20% to 45% by weight, preferably of from 35% to 25% by weight of total monomer in the polymer as styrene. However, the term "copolymer" must not be intended to comprise only two ingredients. Minor amount of monomers other than styrene and butadiene can be present into the polymer formula, such as, for example, styrene derivatives, butadiene derivatives, acrylic derivatives, vinyl derivatives, and the like. By the term "minor amount" is intended an amount of from 0 to 20% by weight, preferably of from 5 to 15% by weight.

Polyvinylacetoversatate compounds useful in the present invention are the polymerization products of vinylacetate and vinylversatate monomers. Vinylversatate monomers are esters of vinylic alcohol with Versatic™ acids (a registered trademark of Shell Chemical Company). Versatic™ acids are trialkylmethane carboxylic acids represented by the following formula:

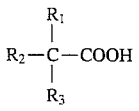

wherein $R_1$, $R_2$ and $R_3$ are alkyl groups of from 1 to 9 carbon atoms and the sum of the carbon atoms thereof is of from 8 to 14.

Versatic™ acid can be then defined as tertiary methane carboxylic acids, with the methane carbon atom completely substituted by alkyl groups at the alpha-position thereof. A variety of tertiary acids of various molecular weight is commercially available as well as their vinyl esters. For semplicity of exposition these acids and esters will be referred to by their commercial names. The term Versatic™ 10 acid, for example, refers to the $C_{10}$ acid, the designation VV™ 10 refers to the vinyl ester of this $C_{10}$ acid. These acids can be prepared by Koch synthesis from olefins plus carbon monoxide and water in presence of an acid catalyst. For example, diisobutylene gives a Versatic™ 9 acid and propylene trimer gives a Versatic™ 10 acid both of them having no hydrogen atoms on the alpha-position thereof.

The styrene-acrylic copolymer useful in the present invention is the product of copolymerization of styrene group and acrylic group reagents to form a copolymer having a nucleus of the following empiric formula:

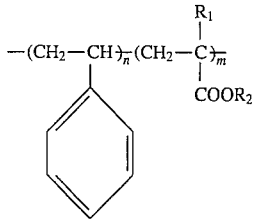

wherein n and m represent the molar percent of the styrene group component and the acrylic group component, respectively, n is at least 50 and m is 100-n, $R_1$ is H or methyl, and $R_2$ is independentely OH or a monovalent organic group.

When the terms "group" or "nucleus" are used to describe a chemical compound or substituent, the described chemical material includes the basic group and that group with conventional substitution. For example, the substituent phenyl group of the styrene group can be substituted with common organic substituents such as alkyl, alkoxy, aryl, aryloxy, halogen, hydroxy, acyloxy, amino, alkylamino, dialkylamino, arylamino, and the like.

The term "copolymer" must not be intended to comprise only two ingredients. Minor amount of monomers other than styrene and acrylic groups can be present into the polymer formula, such as, for example, acrylic derivatives, butadiene derivatives, vinyl derivatives, styrene derivatives, and the like. By the term "minor amount" is intended an amount of from 0 to 20% by weight, preferably of from 5 to 15% by weight. For example, good results can be obtained with copolymers of styrene group and acrylic group comprising from 5 to 15% of butadiene group.

Examples of monovalent organic groups represented by $R_2$ are hydroxy, aryloxy (having from 6 to 12 carbon atoms), alkoxy (having from 1 to 10 carbon atoms), aralkyloxy, having from 7 to 12 carbon atoms), amino, alkylamino or dialkylamino (having from 1 to 10 carbon atoms), arylamino (having from 6 to 12 carbon atoms), acyloxy (having from 1 to 10 carbon atoms), and the like.

Useful examples of acrylic derivatives are acrylic acid, acrylates, methacrylic acid and methacrylates. In particular useful acrylic derivative monomers for the preparation of the styrene-acrylic copolymer are methylacrylate, ethylacrylate, n-propylacrylate, isopropylacrylate, n-butylacrylate, isobutylacrylate, sec-butylacrylate, amylacrylate, hexylacrylate, octylacrylate, 2-phenoxyethylacrylate, 2-chloroethylacrylate, 2-acetoxyethylacrylate, dimethylaminoethylacrylate, benzylacrylate, cyclohexylarylate, phenylacrylate. 2-methoxyethylacrylate, methylmethacrylate, ethylmethacrylate, n-propylmethacrylate, isopropylmethacrylate, n-butylmethacrylate, sec-butylmethacrylate, tert-butylmethacrylate, amylmethacrylate, hexylmethacrylate, cyclohexylmethacrylate, benzylmethacrylate, octylmethacrylate, N-ethyl-N-phenylaminoethylmethacrylate, dimethylaminophenoxyethylmethacrylate, phenylmethacrylate, naphthylmethacrylate, cresylmethacrylate, 2-hydroxyethylmethacrylate, 4-hydroxybutylmethacrylate, 2-methoxyethylmethacrylate, 2-butoxyethylmethacrylate, polyethylene glycol methacrylate and the like.

Useful examples of styrene derivative monomers are styrene, methylstyrene, dimethylstyrene, trimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, methoxystyrene, dimethoxystyrene, chlorostyrene, dichlorostyrene, trichlorostyrene, tetrachlorostyrene, pentachlorostyrene, bromostyrene, iodostyrene, fluorostyrene, and the like.

The polyurethanes, the styrene-butadiene copolymers, the polyvinylacetoversatates, and the styrene-acrylic polymers used in the dye receiving layer of the present invention are provided for coating in the form of latices. The term "latices", "latex" and "latex dispersion" refer to a two phase composition wherein water is the major component of the continuous phase and the dispersed phase comprises minute hydrophobic polymeric particles or micelles having a size range of from 0.01 to 1 μm.

Any method known in the art for the preparation of polymeric latex can be used to prepare the polymer latex useful in the thermal dye transfer receptor of the present invention. In a preferred embodiment, the latices are prepared by emulsion polymerization.

In emulsion polymerization, the monomer or the comonomers are emulsified in a medium, generally water, with the aid of emulsifying agents and in presence of a polymerization initiator or promoter. The monomer(s) is(are) thus present almost entirely as emulsion droplets dispersed in a continuous phase. In the case of co-polymers, the proportion with which the monomers are used is the one which approximately determins the proportions of the repeating units in the resulting copolymer. A proper control of the proportions of the repeating units in the resulting co-polymers can be achieved by taking under consideration the differences in the polymerization rate of the monomers (copolymerization constant). The emulsion polymerization can be performed at hot or cold temperature.

According to this method, polyurethane latices are prepared by chain-extending a prepolymer which is the reaction product of a diisocyanate and an organic compound having at least two active hydrogen atoms. Useful types of organic compounds which have at least two active or free hydrogen atoms include the above mentioned di- or polyfunctional hydroxy compounds. Polyurethane latices are generally prepared by emulsifying the prepolymer and then chain-extending the prepolymer in the presence of a chain-extending agent.

The prepolymer is typically prepared by mixing the organic compounds which have at least two active hydrogen atoms and the diisocyanate, under nitrogen with agitation. Temperature of from about 25° C. to about 110° C. are useful. The reaction is preferably carried out in the presence of a solvent and, optionally, in the presence of a catalyst. Useful solvents include ketones and esters, aliphatic hydrocarbon solvents such as heptanes, octanes and the like, and cycloaliphatic hydrocarbons such methylcyclohexane, and the like. Useful catalysts include tertiary amines, acids and organometallic compounds such as triethylamine, stannous chloride and di-n-butyl tin dilaurate. Where both the reagents and the prepolymer are liquid, the organic solvent is optional.

After the prepolymer is prepared, a latex is formed by emulsifying the prepolymer and chain-extending it in presence of water. Emulsification of the prepolymer may occur in the presence of a surfactant. Where the prepolymer contains charged groups, it may not be necessary to add additional surfactant. Chain-extension of the prepolymer is accomplished by adding a chain-extending agent to the emulsified prepolymer. Useful chain extending agents include water, hydrazine, primary and secondary diamines, amino alcohols, amino acids, hydroxyacids, diols, or mixtures thereof. A preferred group of chain-extending agents includes water and primary or secondary diamines such as 1,4-cyclohexenebis(methylamine), ethylenediamine, diethylenetriamine and the like. The molar amount of chain-extending agent is typically equal to the isocyanate equivalent of prepolymer.

Styrene-butadiene latices can be prepared at hot or cold temperature. By hot-working, i.e., between 40° to 50° C., the average molecular weight of the obtained polymer is about 100,000, while by cold-working, i.e., between 0° to 5° C., the average molecular weight is about 120,000. A more detailed description of emulsion polimerization of styrene-butadiene copolymers can be found in "High Polymers" Vol. IX, F. A. Bovey, et Al. "Emulsion Polymerization", pp. 325–358, Interscience, New York and in the "Encyclopedia of Polymer Science and Technology" Vol. 8, pp. 164 and ff., "Latexes", and Vol. 5, pp 801 and ff., "Emulsion Polymerization", Interscience, New York. Other references describing process to prepare styrene-butadiene copolymer latices can be found in many patents and patent applications, such as, for example, WO 91/017,201, U.S. Pat. No. 4,579,922, U.S. Pat. No. 4,950,711, U.S. Pat. No. 4,717,750, U.S. Pat. No. 4,544,726, U.S. Pat. No. 4,506,057, U.S. Pat. No. 4,385,157, U.S. Pat. No. 4,540,807, EP 40,419, and GB 2,196,011.

A more detailed description of emulsion polymerization of polyvinylacetoversatates can be found in R. W. Tess and W. T. Tsasos, American Chemical Society, Division Organic Coatings Plastics Chemistry Preprint, 26 (2), 276 (1966), A. Mcintosh and C. E. L. Reader, Journal Oil Colour Chemists' Association, 49, 525 (1966), H. A. Oosterhof, Journal Oil Colour Chemists' Association, 48, 256 (1965) and W. T. Tsasos, J. C. Illman, R. W. Tess, Paint Varnish Prod., No 11 (1965).

A more detailed description of emulsion polymerization of styrene-acrylic copolymers can be found in F. A. Bovey et al.,"Emulsion Polymerization", Interscience Publishers, Inc., New York, (1965) and in the "Encyclopedia of Polymer Science and Technology" Vol. 8, pp. 164 and ff., "Latexes", and Vol. 5, pp 801 and ff., "Emulsion Polymerization", Interscience, New York. Other references describing process to prepare styrene-acrylic copolymer latices can be found in many patents and patent applications, such as, for example, WO 91/017,201, U.S. Pat. No. 4,968,741, U.S. Pat. No. 4,474,926, U.S. Pat. No. 4,487,890, U.S. Pat. No. 4,579,922, and U.S. Pat. No. 4,381,365.

For the purpose of the present invention, the polymer latices should have a glass transition temperature of less than 50° C., preferably in the range of from −10° C. to 40° C., more preferably of from −5° to 35° C. The term "glass transition" refers to the characteristic change in the polymer properties from those of a relatively hard, fragile, vitreous material to those of a softer, more flexible substance similar to rubber when the temperature is increased beyond the glass transition temperature ($T_g$).

The dye receiving layer of the present invention can be formed by applying the above described latices on the support by means of well known techniques such as coating, casting, lamination, extrusion and the like. The receiving layer may be a single layer, or two or more of such layers, or an additional layer may be provided on one side of the support. Receiving layers may be formed on both surface of the support. The outermost dye receiving layer can have any desirable thickness, but generally a thickness of from 1 to 50 μm, and more preferably of from 3 to 30 μm is used. When a double layer structure is used, the preferred thickness of the outermost layer is of from 0.1 to 20 μm, more preferably of from 0.2 to 10 μm. The thermal dye transfer receptor of the present invention may also have one or more intermediate layers between the support and the image receiving layer. Depending on the material from which they are formed, the intermediate layers may function as a cushioning layer, porous layer or dye diffusion preventing layers, or may fulfill two or more of these functions. They may also serve the purpose of being an adhesive or primer, depending on the particular application. Dye diffusion preventing layers are layers which prevent the dye from diffusing into the donor support layer. The binder used to form these intermediate layers may be water soluble or organic solvent soluble, but the use of water soluble binders is preferred, and gelatin is especially desirable. Porous layers are layers which prevent the heat which is applied at the time of thermal transfer from diffusing from the receiving layer to the support. This ensures that the heat which has been applied is used efficiently.

As the support for the thermal dye transfer receptor of the present invention, any support known in the art can be used. Specific examples of suitable supports are 1) synthetic paper supports, such as polyolefin and polystyrene based synthetic papers, 2) paper supports, such as top quality paper, art paper, coated paper, cast coated paper, wall paper, lining paper, papers which are impregnated with synthetic resins or emulsions, papers which are impregnated with synthetic rubber latexes, papers with added synthetic resins, cardboard, cellulose fiber papers and polyolefin coated papers, and 3) various synthetic resin films or sheets made of synthetic resins such as polyolefins, polyvinylchloride, polyester, polystyrene, acrylates, methacrylates or polycarbonate, and films or sheets obtained by rendering these synthetic resins white and reflective. In a preferred embodiment of the present invention the support consists of paper, polyolefin coated paper, polyester or white-pigmented polyester (i.e., pigmented with titanium oxide, zinc oxide, etc.). Polyolefin coated papers are described, for example, in "The Fundamental of Photo-engineering, (Silver Salt Photography Edition)", Japanese Photography Society Publication, pp. 223–240, published by Corona, 1979. The polyolefin coated papers fundamentally comprise a supporting sheet which has a layer of polyolefin coated on the surface. The supporting sheet is generally made from a material other than a synthetic resin and top quality cellulosic paper is generally used. The polyolefin coating may be prepared using any method, provided that the polyolefin layer is in intimate contact with the surface of the supporting sheet. Usually an extrusion process is employed. The polyolefin coated layer may be on the side of the supporting sheet on which the receiving layer is present but it may also be on both sides of the supporting sheet. High density polyethylene, low density polyethylene, polypropylene, and any other polyolefin can be used as the polyolefin. The use of material which has low thermal conductivity is preferred on the side of the paper on which the receiving layer is present. This provide a thermal insulating effect during transfer. For the purpose of the present invention, whatever support is used, the following surface physical requirement are desired: 1) The water absorption value must be lower than 30 g/m$^2$, and 2) the roughness value (Ra) must be in the range of from 20 to 150 μm. Moreover, the thickness of the support is in the range of from 50 to 300 μm, preferably of from 100 to 200 μm. Water absorbtion value is measured at five second according to Test Method for Water Absorption of Paper and Paperboard prescribed in JIS P-8140 (Cobb's method).

Antistatic agents can be included in the receiving layer or on the surface thereof on at least one side of the thermal dye transfer receptor of the present invention. Examples of useful antistatic agents include surfactants, for example, cationic surfactants (such as quaternary ammonium salts, polyamine derivatives, etc.), anionic surfactants (alkylphosphates, etc.), amphoteric surfactants and nonionic surfactants, and also conductive particulates, including metal oxide such as aluminium oxide and tin oxide, etc. In structures in which a receiving layer is present only on one surface, an antistatic agent may also be used on the surface opposite to that on which the receiving layer is present.

Fine powder of, for example, silica, clay, talc, diatomaceaous earth, calcium carbonate, calcium sulfate, barium sulfate, aluminium silicate, synthetic zeolites, zinc oxide, or titanium oxide can also be added to the receiving layers, intermediate layers, protective layers, backing layers, etc. of the thermal dye transfer receptor of the present invention.

Release agents may be included in the receiving layers, and especially in the outermost receiving layer. A release agent layer may be formed over the receiving layer, in the dye thermal transfer receptor of the present invention, to improve the release properties with respect to the thermal dye transfer donor. Solid waxes, such as polyethylene wax, amide wax, fluorine based and phosphate based surfactants and silicone oils can be used as release agents, but the use of silicone oils is preferred. The silicone oils can be used in the form of inert oils, but a silicone oil which is curable is preferably used. The thickness of the release agent layer is from 0.01 to 5 μm, and preferably from 0.05 to 2 μm. The release agent layer may be formed by forming a mixture of silicone oil and the receiving layer composition, coating the mixture onto the substrate and then curing the silicone oil which subsequently bleeds out onto the surface of the receiving layer.

Agents which reduce color fading can also be included in the receiving layer described above in the present invention. Suitable anti-color fading agents include antioxidants, ultraviolet absorbers and various metal complexes. Examples of antioxidants include chroman based compounds, coumarine based compounds, phenol based compounds (for example, hindered phenols), hydroquinone derivatives, hindered amine derivatives and spiroindane derivatives. Examples of appropriate ultraviolet absorbers include benzotriazole based compounds (for example, as disclosed in U.S. Pat. No. 3,533,794), 4-thiazolidone based compounds (for example, as disclosed in U.S. Pat. No. 3,352,681), benzophenone based compounds (for example as disclosed in JP-A-46-2784) and other compounds disclosed, for example, in JP-A-54-48535, JP-A-62-136641 and JP-A-61-88256. Example of useful metal complexes include compounds disclosed, for example, in U.S. Pat. Nos. 4,241,155, 4,245,018, 4,254,195. The above mentioned antioxidants, ultraviolet absorbers and metal complexes may be used in combination, if desired.

Moreover, fluorescent whiteners can be included in the receiving layer used in the present invention. The compounds described, for example, in K. Venkataraman, *The Chemistry of Synthetic Dyes,* Volume 5, Chapter 8 are representative examples of fluorescent whiteners. Suitable fluorescent whitener include stilbene based compounds, coumarin based compounds biphenyl based compounds, benzoxazolyl based compounds, naphthalimide based compounds, pyrazoline based compounds, carbostyryl based compounds, 2,5-dibenzoxazolylthiophene based compounds, etc. The fluorescent whiteners can be used in combination with anti-color fading agents, if desired.

The thermal dye transfer receptors of the present invention are used in combination with thermal dye transfer donors. In fact, another aspect of the present invention relates to a thermal dye transfer material comprising a thermal dye transfer donor having at least one dye donating layer comprising a thermomobile dye dispersed in a binder and a thermal dye transfer receptor which can be imagewise printed with dyes which migrate from said thermal dye transfer donor by means of heating, comprising a support and at least one dye receiving layer coated on at least one side of said support, said at least one dye receiving layer being in contact with said dye donating layer, and comprising a dye-accepting polymeric latex selected from the group consisting of polyurethane latices, styrene-butadiene latices, polyvinylacetoversatate latices, and styrene-acrylic latices.

Thermal dye transfer donors are fundamentally materials which have a thermal transfer layer which contains a thermomobile dye and a binder on a support. The thermal dye transfer donors are formed by preparing a coating ink by dissolving or dispersing a thermomobile dye and a binder resin in a suitable solvent and coating this ink at a rate providing a dry film thickness of from about 0.2 to 5 μm, and preferably from 0.4 to 2 μm, for example, on one side of a support of the type used conventionally for thermal dye transfer donor sheets and drying the ink to form the thermal dye transfer layer. More commonly, the inks may be printed on the donor base by rotogravure or other printing techniques giving a sequence of the primary color areas and, if desired, also black ones. Usually an adhesive or subbing layer is provided between the support and the dye layer. Normally the opposite side is covered with an antisticking layer to avoid sticking and other undesirable interactions with the thermal heads. An adhesive layer may be provided between the support and the antisticking layer.

The dye layer may be a monochrome dye layer or it may comprise sequential repeating areas of different colored dyes like e.g., cyan, magenta, yellow and optionally black hue. When a dye-donor element containing three or more primary colored areas is used, a multicolor image can be obtained by sequentially performing the dye transfer process steps for each color in a registered way. Other non-traditional dye colors may also be used if desired.

Besides the areas containing dyes, an area containing (a) thermally transferable UV-absorbing and/or antioxidizing compound(s) can be provided on the donor element. After transfer of the dye(s), the UV-absorbing compound is transferred onto the receptor. Said transferred compounds then aid in preventing the photodegradation of the transferred dye images by UV-radiation e.g., in the exposure to sunlight. Obviously, in addition to the UV-protecting layer and/or antioxidizing layer, any other type of protecting layer may be thermally transferred from the donor. Of course the protecting layer transfer is preferably made in a non-imagewise manner.

Typical and specific dyes for use in thermal dye transfer must have adequate thermal transferability, excellent color gamut, high coloring power, good stability, low manufacturing cost, and good solubility. Examples of said dyes have been described, for example, in EP Patent Application Nos. 209,990, 209,991, 216,483, 218,397, 227,095, 227,096, 229, 374, 235,939, 247,737, 257,577, 257,580, 258,856, 279,330, 279,467, 285,665, 301,752, 302,627, 312,211, 321,923, 327, 063, 327,077, 332,924, and in U.S. Pat. Nos. 4,664,671, 4,698,651, 4,701,439, 4,743,582, 4,753,922, 4,753,923, 4,757,046, 4,764,178, 4,769,360, 4,771,035, 4,853,366, 4,859,651.

As examples of the polymeric binder for the dye donor layer, the following can be used: cellulose derivatives, such as ethyl cellulose, hydroxyethyl cellulose, ethylhydroxy cellulose, nitrocellulose, cellulose acetate formate, cellulose acetate, cellulose acetate hydrogen phthalate, cellulose triacetate; vinyl-type resins and derivatives, such as polyvinyl alcohol, polyvinyl chloride, chlorinated polyvinyl chloride, polyvinyl acetate, polyvinyl butyral, copolyvinyl-butyral-acetal-alcohol, polyvinyl pyrrolidone, polyvinyl acetoacetal, polyacrylamide; polymers and copolymers derived from acrylates and acrylate derivatives, such as polyacrylic acid, polymethyl methacrylate, and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic.

The dye layer may also contain other additives, such as curing agents, preservatives, organic or inorganic fine particles, dispersing agents, antistatic agents, defoaming agents, viscosity controlling agents, hardening agents, etc. These and other ingredients being described more fully in EP Patent Application Nos. 133,011,133,012, 111,004, and 279, 467.

Any material can be used as the support for the dye donor element provided that it is dimensionally stable and capable of withstanding the temperature involved, up to 400° C. over a period of up to 20 msec., and is yet thin enough to trasmit heat applied on one side through to the dye on the other side to effect transfer to the receptor within the short imaging period, typically of from 1 to 20 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising a polyester such as polyethylene glycol terephthalate. In general, the support has a thickness of 2 to 30 μm. The support may also be coated with an adhesive or subbing layer, if desired. The dye layer of the dye donor element may be coated on the support or printed thereon by a printing technique such as a gravure process, a spraying technique, and the like.

A dye barrier layer comprising a hydrophilic polymer may also be employed in the dye donor element between its support and the dye layer to improve the dye transfer densities by preventing wrong-way transfer of dye towards the support. The dye barrier layer may contain any hydrophilic material which is useful for the intended purpose. Suitable dye barrier layers have been described in e.g., EP 227,091 and EP 228,065.

As previously stated, preferably the reverse side of the dye donor element is coated with an antistick or slip layer to prevent the printing head from sticking to the dye donor element. Such a slip layer can comprise a lubricating material such as a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Example of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in, e.g., EP 138,483 227,090, U.S. Pat. Nos. 4,567,113, 4,717,711.

The dye layer of the dye donor element may also contain a releasing agent that aids in separating the dye donor element from the dye receptor element after transfer. The releasing agents can also be applied in a separate layer on at least part of the dye layer. As releasing agents, solid waxes, fluorine- or phosphate-containing surfactants and silicone oils are generally used. Suitable releasing agents are described in e.g., EP 133,012 and 227,092.

In another aspect the present invention relates to a process for generating a multicolor image by thermal dye transfer comprising the steps of:

a) providing a thermal dye transfer donor comprising a substrate with a thermally transferable dye on one surface of the substrate, b) providing a thermal dye transfer receptor having a substrate with at least one dye receiving layer, c) positioning the surface of said thermal dye transfer donor having a thermally transferable dye thereon so that surface is in contact with the dye receiving layer of the thermal dye transfer receptor, d) heating the thermal dye transfer donor in an imagewise manner to transfer dye from the donor sheet to the dye receiving layer, and e) repeating step a), b), c) and d) for each dye to be imagewise printed, wherein the dye receiving layer comprises a latex selected from the group consisting of polyurethane latices, styrene-butadiene latices, polyvinylacetoversatate latices, and styrene-acrylic latices.

The thermal dye transfer process of forming the image comprises placing the dye layer of the donor in face-to-face relation with the dye receiving layer of the receptor and imagewise heating from the back of the donor. The transfer of the dye is accomplished by imagewise heating for milliseconds at a temperature up to about 400° C.

When the process is performed for only one single color, a monochrome dye transfer image is obtained. A multicolor image can be obtained by sequentially using monochrome donors or using a donor containing three or more primary color dyes and sequentially performing the process steps described above for each color.

The above sandwich of donor and receptor is formed in a time sequence during the different color exposure. After the first dye has been transferred, the elements are peeled apart. A second dye-donor (or another area or the same donor with a different dye) is then printed in register with the dye receptor and the process is repeated. The third color and optionally further colors are obtained in the same manner.

In order to accomplish a good registration when the process is performed for more than one color and in order to detect what color is existing at the printing portion of the donor, detection marks are commonly provided on one surface of the donor and on the drum holding the media.

The dye receptor can also have detection marks provided on one surface, preferably the back surface, so that the receiving element can be accurately set at a desired position before transfer, whereby the image can be formed at a correct desired position.

In addition to thermal heads, laser light, infrared flash or heated pens can be used as the heat source for supplying heat energy. Thermal printing heads that can be used to transfer dye from the dye donor to a receptor are commercially available. In case laser light is used, the dye layer or another layer of the dye element has to contain a compound that adsorbs the light emitted by the laser and converts it into heat, e.g., specific dyes or carbon black.

Alternatively, the support of the dye-donor may be an electrically resistive ribbon consisting of, for example, a multi-layer structure of a carbon loaded polycarbonate coated with a thin aluminium film. Current is applied to the resistive ribbon by electrically adressing a print head electrode resulting in highly localized heating of the ribbon beneath the relevant electrode. The fact that in this case the heat is generated directly in the resistive ribbon and that it is the ribbon which gets hot leads to an inherent advantage in printing speed. In the thermal head technology, the various elements of the thermal head must get hot and must cool down before the head can move to the next printing position.

In order to eliminate the shortcoming of large unused portions remaining on each dye donor, the following alternatives known under the abbreviation of MUST (i.e., multi-use transfer) can be applied: an equal speed mode is used in which a donor and a receptor are moved at the same speed for using the donor element in repetition, and a differential mode is used in which the running speed of the donor is made lower than that of the receptor so that the overlappingly used portions of the donor at the first use and the second use are shifted little by little. A description of multi-use application can be found in GB 2,222,692. In order to obtain a sufficient density of the transferred image after multi-use of the donor element, dyes yielding high density transferred image are preferably used.

In a further aspect the present invention relates to the imaged bearing dye receptor obtained by said process and comprising a support having on at least one surface thereof a dye receiving layer having at least two different dyes adhered to said layer, each of said two dyes being distributed over said layer in an imagewise, non-continuous manner, wherein said dye receiving layer comprises a latex selected from the group consisting of polyurethane latices, styrene-butadiene latices, polyvinylacetoversatate latices, and styrene-acrylic latices. As previously disclosed, any support known in the art can be used. For the purpose of the present invention, whatever support is used, the following surface physical requirement are desired: 1) The water absorption value must be lower than 30 g/m$^2$, and 2) the roughness value (Ra) must be in the range of from 20 to 150 μm. Moreover, the thickness of the support is in the range of from 50 to 300 μm, preferably of from 100 to 200 μm. Water absorption value is measured at five second according to Test Method for Water Absorption of Paper and Paperboard prescribed in JIS P-8140 (Cobb's method). The receiving layer may be a single layer, or two or more of such layers, or an additional layer may be provided on one side of the support. Receiving layers may be formed on both surface of the support. The outermost dye receiving layer can have any desirable thickness, but generally a thickness of from 1 to 50 μm, and more preferably of from 3 to 30 μm is used. For the purpose of the present invention, the polymer latices should have a glass transition temperature of less than 50° C., preferably in the range of from −10° C. to 40° C., more preferably of from −5° to 35° C. The term "glass transition" refers to the characteristic change in the polymer properties from those of a relatively hard, fragile, vitreous material to those of a softer, more flexible substance similar to rubber when the temperature is increased beyond the glass transition temperature ($T_g$). The term "latices", "latex" and "latex dispersion" refer to a two phase composition wherein water is the major component of the continuous phase and the dispersed phase comprises minute hydrophobic polymeric particles or micelles having a size range of from 0.01 to 1 μm.

The following examples are given to further illustrate the present invention. Unless otherwise indicated all parts, percents, ratios and the like are expressed by weight.

EXPERIMENTAL CONDITIONS

1) SAMPLE PRINTING a) Printer

As the test printer was used a thermal printer having a drum with the receptor and donor sandwich held under a pressure of two kilograms. A commercial Kyocera KMT 128 200 dot per inch thermal head was used. This thermal head has the following characteristics:

Printing width: 128 mm
No. of dots: 1,024 (4 block of 256 dots each)
Dot density: 8 dots/mm
Dot size: 0.105 (H)×0.200 (V) $mm^2$
Average resistance: 952 Omega b) Printing Conditions For recording each dot with up to 64 grey levels, each heat element of the thermal head is heated by giving a different number of strobe pulses and a convenient burn profile. The "burn profile" defines a sequence of strobe pulses (on/off) giving the printing energy. Of course the printing energy depends on the applied power, the burn profile and the other printing conditions, some of which are dependent on the particular printer configuration used. The comparability of the experiments here presented is assured in that all the samples of the examples were printed in the same experimental conditions, including the same burn profile, the same power supply and the same digital image.

The printed digital image is a stepwise pattern comprising 16 steps according to a linear energy variation. The maximum exposure is assumed as the highest one not causing burning or mass transfer by printing the commercial combination of the Mitsubishi CK 100 S yellow, magenta, cyan donors and the Mitsubishi CK 100 S receptor in the foresaid printing condition configuration. Hence all the receptors of the examples illustrating the present invention were printed by using as a standard reference the commercial Mitsubishi CK 100S yellow, magenta, cyan donors printed as the standard reference.

2) SAMPLE EVALUATION

The 16 steps of the yellow, magenta, and cyan images obtained by printing the different receptors of the example with the Mitsubishi CK 100 S yellow, magenta, and cyan donors were evaluated first by using the Gretag spectrophotometer type SPM 100 giving the L*, a*, b* color coordinates and the yellow, magenta, and cyan sensitometries.

L*, a* and b* values are determined according the CIE (L*a*b*) method using a standard CIE Source B illumination source. This method, identified as the CIE 1976 (L*a*b*)-Space, defines a color space where the term L* defines the perceived lightness with greater value indicating lighter tone, the term a* defines hue along a green-red axis with negative values indicating more green hue and positive values indicating more red hue, and the term b* defines hue along a yellow-blue axis with negative values indicating more blue hue and positive values indicating more yellow hue. The CIE 1976 (L*a*b*)-Space is defined by the equations:

$$L^*=116(Y/Y_n)^{1/3}-16$$

$$a^*=500[(X/X_n)^{1/3}-(Y/Y_n)^{1/3}]$$

$$B^*=200[(Y/Y_n)^{1/3}-(Z/Z_n)^{1/3}]$$

where X,Y,Z are the CIE tristimulus values of the observed color, and $X_n$, $Y_n$, $Z_n$ are tristimulus values of the standard illuminant. Color difference (ΔE*) and hue difference (ΔH*) between two colors can be measured by the following expressions:

$$\Delta E^*=[(\Delta L^*)^2+(\Delta a^*)^2+(\Delta b^*)^2]^{1/2}$$

$$\Delta H^*=[(\Delta E^*)^2+(\Delta L^*)^2+(\Delta C^*)^2]^{1/2}$$

A more detailed description of the CIE 1976 (L* a* b*)-Space can be found in R. W. G. Hunt, *Measuring Color*, J. Wiley & Sons, New York.

3) FASTNESS TEST

After the evaluation of the freshly obtained image, the samples were submitted to a stability test consisting in the irradiation with UV-visible light source, under controlled conditions of temperature.

The UV-visible light fastness test selected to evaluate the receptors of the examples is as follows:

In a black box having the dimensions of 80×80×90 cm, a 450 W super-high pressure mercury lamp (Osram™ HBO) is located at the center of one box face, while on the opposite face (90 cm far and having a curvature to provide the same distance of all its point from said mercury lamp) are fixed the printed samples after the previous evaluation and color measurements. The box is provided with a ventilation system to keep the temperature constant at the different points of the box and to refrigerate the lamp, so that during the irradiation the temperature of the samples is kept at 37° C. The test is conducted by supplying about 22 Amperes to said lamp and adjusting the current to get a comparable luminance during the life of the lamp. The test duration is 98 hours. Reference samples are used in every test to control the consistency of the irradiation level. Moreover the data of the example are comparable because the samples were exposed all together in the same irradiation run. No UV filter was located between the light source and the sample. After the test, the sample are again evaluated as described for the freshly printed ones so that the image fastness of the different prints is obtained in terms of color variation, hue variation, densitometry variation in the homologous zones of the sensitometric curves.

For simplicity and clarity of comparison, to illustrate the present invention only the data of color, hue and densitometry variation measured at the step 1 (Dmax) are given.

EXAMPLE 1

A set of aliphatic polyurethane latices (10 g) according to the following Table A were mixed with 3 g of 10% water solution of BYK™ 341 modified polysiloxane copolymer manufactered by Byk Chemic GmbH as a wetting agent and coated, using a Erichsen 305 coating machine, at 50 μm gap and 2 cm/sec on photographic hydrophilic side of a Schoeller PE 2136/X-10 24×40 cm paper sheet giving about 15 μm dry layer. The following four different thermal dye receiving layers were obtained:

TABLE A

| Receptor | Latex | Manufacturer |
|---|---|---|
| 1 inv. | Bayhydrol ™ 2884 aliphatic polyurethane aqueous latex Tg = 25° C. | Bayer |
| 2 inv. | Bayhydrol ™ VP-LS 2953 aliphatic polyurethane aqueous latex Tg = 0° C. | " |
| 3 inv. | Bayhydrol ™ VP-LS 2884 aliphatic polyurethane aqueous latex Tg = 25° C. | " |
| 4 comp. | Desmolac ™ 4340 aliphatic polyurethane organic solvent dispersion | Huls |

On said receiving layers a very thin protective layer of polysiloxane BYK™ 330 was coated at 15 μm gap in terms of 1.25% solution of BYK™ 330 in methyl alcohol, obtaining four thermal dye transfer receptors. The receptors of the present invention (No. 1,2,3) obtained by coating polyurethane latices, the comparison receptor (No. 4) obtained by coating a polyurethane similar to the previous ones but in terms of organic solvent solution, and the CK 100 S Mitsubishi reference receptor (No. 5) were printed, evaluated and submitted to the fastness test according the "EXPERIMENTAL CONDITION" previously described.

The following table 1 summarizes the results of color and hue differences between fresh and aged images measured at Dmax (step 1) for each yellow, magenta and cyan layer.

TABLE 1

| Receptor | | 1 | 2 | 3 | 4 | 5 |
|---|---|---|---|---|---|---|
| Color | y | 27.46 | 14.61 | 24.70 | 11.67 | 34.38 |
| Diff. | m | 5.99 | 4.43 | 7.72 | 21.73 | 15.47 |
| (ΔE) | c | 21.20 | 6.27 | 21.10 | 26.52 | 32.78 |
| Hue | y | 3.00 | 2.67 | 3.38 | 1.20 | 2.37 |
| Diff. | m | 1.38 | 0.39 | 0.20 | 12.41 | 5.89 |
| (ΔH) | c | 0.43 | 3.13 | 3.64 | 5.41 | 15.81 |
| Dmax | y | 1.221 | 1.515 | 1.218 | 1.356 | 1.264 |
| | m | 1.386 | 1.692 | 1.513 | 1.495 | 1.435 |
| | c | 1.261 | 1.122 | 1.488 | 1.575 | 1.592 |

y = yellow
m = magenta
c = cyan

The analysis of the data of table I clearly shows the net superiority of the image fastness, in terms of lower values of color and hue differences, given by the polyurethane latex receptors of the present invention, in comparison with the fastness given by a polyurethane coated from an organic solvent solution. In particular the lower values of hue difference show a strong stability of the tint of color, i.e., a yellow color after fading may turn pale, but it does not turn to a greenish or reddish color.

EXAMPLE 2

A set of polyvinyl latices as disclosed in JP 60/038,192, and a set of styrene-butadiene and polyvynilacetoversatate latices, according to the following Table B were coated under the same conditions described in Example 1. The following thirteen different thermal dye receiving layers were obtained:

TABLE B

| Receptor | Latex | Manufacturer |
|---|---|---|
| 1 inv. | LITEX ™ X5621 Tg = 40° styrene-butadiene | Huls |
| 2 inv. | LITEX ™ PS 5520 Tg = 3° styrene-butadiene | " |
| 3 inv. | LIPOLAN ™ NW 5022 Tg = 6° styrene-butadiene | " |
| 4 inv. | LIPOLAN ™ 4812 Tg = 20° styrene-butadiene | " |
| 5 inv. | LIPOLAN ™ NW 5522 Tg = 4° styrene-butadiene | " |
| 6 inv. | RAVEMUL ™ PC2 polyvinylacetoversatate | Enichem Synth. |
| 7 inv. | RAVEMUL ™ T40 polyvinylacetoversatate | " |
| 8 inv. | RAVEMUL ™ T33 polyvinylacetoversatate | " |
| 9 inv. | RAVEMUL ™ PC2 (+) polyvinylacetoversatate | " |
| 10 inv. | RAVEMUL ™ 023 polyvinylacetoversatate | " |
| 11 comp. | RAVEMUL ™ M11 polyvinylacetate | " |
| 12 comp. | RAVIFLEX ™ S7 polyvinylalcohol | " |
| 13 comp. | MOWLITH ™ DM6 polyvinylacetate-ester copolymer | Hoechst |

(+) = BYK ™ 301 wetting agent was used

On said receiving layers a very thin protective layer of polysiloxane BYK™ 330 was coated at 15 μm gap in terms of 1.25% solution of BYK™ 330 in methyl alcohol, obtaining five thermal dye transfer receptors. The receptors of the present invention (No. 1 to 10), the comparison receptors (No. 11 to 13), and the CK 100 S Mitsubishi reference receptor (No. 14) were printed, evaluated and submitted to the fastness test according the "EXPERIMENTAL CONDITION" previously described.

The following table 2 summarizes the results of color and hue differences between fresh and aged images measured at Dmax (step 1) for each yellow, magenta and cyan layer.

TABLE 2

| | COLOR DIFFERENCE | | | HUE DIFFERENCE | | | Dmax | | |
|---|---|---|---|---|---|---|---|---|---|
| REC. | Y | M | C | Y | M | C | Y | M | C |
| 1 | 16.15 | 4.37 | 15.18 | 0.56 | 3.46 | 6.97 | 1.085 | 1.218 | 1.310 |
| 2 | 17.33 | 16.19 | 23.87 | 0.74 | 0.65 | 4.19 | 0.826 | 1.511 | 1.604 |
| 3 | 15.77 | 19.58 | 20.26 | 0.21 | 1.85 | 1.92 | 0.804 | 1.527 | 1.547 |
| 4 | 27.19 | 25.91 | 24.67 | 1.13 | 3.99 | 1.21 | 0.925 | 1.574 | 1.565 |
| 5 | 13.74 | 20.61 | 20.44 | 0.46 | 2.70 | 1.41 | 0.740 | 1.430 | 1.581 |
| 6 | 13.58 | 6.14 | 13.75 | 1.09 | 3.24 | 3.40 | 1.374 | 1.514 | 1.448 |
| 7 | 7.38 | 3.45 | 21.31 | 1.95 | 2.64 | 4.13 | 0.709 | 1.075 | 1.311 |
| 8 | 11.34 | 5.33 | 15.78 | 1.91 | 5.27 | 2.08 | 0.948 | 1.242 | 1.340 |
| 9 | 9.37 | 5.42 | 16.79 | 1.74 | 4.68 | 0.30 | 0.872 | 1.234 | 1.440 |
| 10 | 13.97 | 5.42 | 19.05 | 3.22 | 3.44 | 0.99 | 1.028 | 1.329 | 1.380 |
| 11 | 15.88 | 14.03 | 28.86 | 1.57 | 4.91 | 6.24 | 0.607 | 0.991 | 0.880 |
| 12 | 40.99 | 9.28 | 8.81 | 6.94 | 0.71 | 1.56 | 0.605 | 0.647 | 0.422 |
| 13 | 40.36 | 5.11 | 15.93 | 10.67 | 3.15 | 6.35 | 1.100 | 1.384 | 1.079 |
| 14 | 34.38 | 15.47 | 32.78 | 2.37 | 5.89 | 15.81 | 1.264 | 1.435 | 1.592 |

Y = yellow
M = magenta
C = cyan

The analysis of the data of table 2 clearly shows the superiority of the image fastness, in terms of lower values of color and hue differences, given by the styrene-butadiene and polyvinylacetoversatate latex receptors of the present invention, in comparison with the fastness given by conventional polyvinyl latex receptors. In particular the lower values of hue difference show a strong stability of the tint of color, i.e., a yellow color after fading may turn pale, but it does not turn to a greenish or reddish color.

EXAMPLE 3

A set of polyacrylic latices as disclosed in JP 60/038,192 and styrene-acrylic copolymer latices according to the following Table C were coated according to the same conditions of previous Example 1. The following six different thermal dye receiving layers were obtained:

TABLE C

| Receptor | Latex | Manufacturer |
|---|---|---|
| 1 inv. | LIPATON ™ AE4620 Tg = 20° C. styrene-acrylic latex | Huls |
| 2 comp. | AC ™ styrene-acrylic organic dispersion | Goodyear |
| 3 comp. | PRIMAL ™ AC 2536 acrylic copoymer Tg = 5° C. | Rohm & Haas |
| 4 comp. | PRIMAL ™ AC 61 acrylic copolymer Tg = 18° C. | " |
| 5 comp. | PRIMAL ™ HA 12 acrylic copolymer Tg = 19° C. | " |
| 6 comp. | PRIMAL ™ HA 16 acrylic copolymer Tg = 35° C. | " |

On said receiving layers a very thin protective layer of polysiloxane BYK™ 330 was coated at 15 μm gap in terms of 1.25% solution of BYK™ 330 in methyl alcohol, obtaining six thermal dye transfer receptors. The receptor of the present invention (No. 1) obtained by coating a styrene-acrylic copolymer latex, the comparison receptors (No. 2 to 6) obtained by coating a polyacrylic latex of the prior art, and the CK 100 S Mitsubishi reference receptor (No. 7) were printed, evaluated and submitted to the fastness test according the "EXPERIMENTAL CONDITION" previously described. The following table 3 summarizes the results of color and hue differences between fresh and aged images measured at Dmax (step 1) for each yellow, magenta and cyan layer.

TABLE 3

| | COLOR DIFFERENCE | | | HUE DIFFERENCE | | | Dmax | | |
|---|---|---|---|---|---|---|---|---|---|
| REC. | Y | M | C | Y | M | C | Y | M | C |
| 1 | 3.05 | 6.03 | 13.61 | 0.77 | 1.56 | 4.46 | 1.187 | 1.684 | 1.658 |
| 2 | 10.18 | 19.21 | 31.27 | 0.37 | 5.30 | 12.20 | 0.609 | 0.967 | 1.171 |
| 3 | 29.56 | 39.03 | 49.93 | 3.54 | 13.85 | 15.78 | 0.947 | 1.105 | 0.984 |
| 4 | 34.43 | 75.65 | 56.18 | 6.87 | 12.53 | 10.34 | 1.048 | 1.207 | 1.068 |
| 5 | 25.40 | 52.15 | 58.40 | 6.29 | 1.46 | 12.23 | 0.976 | 1.583 | 1.553 |
| 6 | 25.47 | 48.16 | 48.63 | 4.24 | 10.26 | 5.41 | 0.918 | 1.033 | 0.859 |
| 7 | 34.38 | 15.47 | 32.78 | 2.37 | 5.89 | 15.81 | 1.264 | 1.435 | 1.592 |

Y = yellow
M = magenta
C = cyan

The analysis of the data of table 3 clearly shows the net superiority of the image fastness, in terms of lower values of color and hue differences, given by the styrene-acrylic copolymer latex receptor of the present invention, in comparison with the fastness given by conventional polyacrylic latex receptors. In particular the lower values of hue difference show a strong stability of the tint of color, i.e., a yellow color after fading may turn pale, but it does not turn to a greenish or reddish color.

EXAMPLE 4

A set of styrene-acrylic-butadiene terpolymer latices (having a monomer weight percentage of about 50–70 styrene, 20–30 acrylic, and 5–15 butadiene) according to the following Table D were coated according to the same conditions of previous Example 1. The following three different thermal dye receiving layers were obtained:

TABLE D

| Receptor | Latex | Manufacturer |
|---|---|---|
| 1 inv. | EUROPRENE ™ CC136 | Enimont |
| 2 inv. | EUROPRENE ™ 1714 | " |
| 3 inv. | EUROPRENE ™ 1721 | " |

On said receiving layers a very thin protective layer of polysiloxane BYK™ 330 was coated at 15 μm gap in terms of 1.25% solution of BYK™ 330 in methyl alcohol, obtaining three thermal dye transfer receptors. The receptors of the present invention (No. 1 to 3) obtained by coating a styrene-acrylic-butadiene terpolymer latex, and the CK 100 S Mitsubishi reference receptor (No. 4) were printed, evaluated and submitted to the fastness test according the "EXPERIMENTAL CONDITION" previously described.

The following table 4 summarizes the results of color and hue differences between fresh and aged images measured at Dmax (step 1) for each yellow, magenta and cyan layer.

TABLE 4

| | COLOR DIFFERENCE | | | HUE DIFFERENCE | | | Dmax | | |
|---|---|---|---|---|---|---|---|---|---|
| REC. | Y | M | C | Y | M | C | Y | M | C |
| 1 | 8.69 | 8.90 | 1.27 | 2.13 | 8.43 | 0.77 | 1.508 | 2.075 | 1.806 |
| 2 | 26.25 | 17.49 | 6.78 | 0.45 | 15.73 | 2.36 | 1.280 | 1.979 | 1.995 |
| 3 | 24.49 | 17.28 | 4.52 | 0.91 | 15.94 | 1.78 | 1.432 | 1.952 | 1.977 |
| 4 | 34.38 | 15.4 | 32.78 | 2.37 | 5.89 | 15.81 | 1.264 | 1.435 | 1.592 |

Y = yellow
M = magenta
C = cyan

The analysis of the data of table 4 clearly shows the superiority of the image fastness, in terms of lower values of color and hue differences, given by the styrene-acrylic-butadiene terpolymer latex receptor of the present invention, in comparison with the fastness given by conventional receptor. A significative improvement in Dmax is also obtained.

We claim:

1. A process for generating a multicolor image by thermal dye transfer comprising the steps of:

a) providing a image bearing dye transfer donor comprising a substrate with a thermally transferable dye on one surface of the substrate, b) providing a image bearing dye transfer receptor having a substrate with at least one dye-receiving layer, c) positioning the surface of said thermal dye transfer donor having a thermally transferable dye thereon so that said surface is in contact with said at least one dye-receiving layer of said thermal dye transfer receptor, d) heating said thermal dye transfer donor in an imagewise manner to transfer dye from said donor sheet to said at least one dye-receiving layer, and e) repeating steps a), b), c) and d) for each dye to be imagewise printed, characterized in that said dye-receiving layer consists essentially of a dried polymeric latex selected from the group consisting of polyurethane latices, polyvinylacetoversatate latices, and styrene-acrylic latices.

2. A thermal dye transfer material comprising a thermal dye transfer donor having at least one dye donating layer comprising a thermomobile dye dispersed in a binder and a thermal dye transfer receptor which can be imagewise printed with dyes which migrate from said thermal dye transfer donor by means of heating, comprising a support and at least one dye receiving layer coated on at least one side of said support, said at least one dye receiving layer being in contact with said dye donating layer, and consisting essentially of a dye-accepting dried polymeric latex selected from the group consisting of polyurethane latices, styrene-butadiene latices, polyvinylacetoversatate latices, and styrene-acrylic latices.

3. An imaged dye receptor comprising a support having on at least one surface thereof a dye receiving layer having a thermal dye transfer image comprising at least two different dyes adhered to said layer, each of said two dyes being distributed over said layer in an imagewise, non-continuous manner, characterized in that said dye receiving layer consists essentially of a dried polymeric latex selected from the group consisting of polyurethane latices, polyvinylacetoversatate latices, and styrene-acrylic latices.

4. An image bearing dye receptor according to claim 3, characterized in that said support has a thickness of from 50 to 300 μm.

5. An image bearing dye receptor according to claim 3, characterized in that said support has a thickness of from 100 to 200 μm.

6. An image bearing dye receptor according to claim 3, characterized in that said support has a roughness value (Ra) of from 20 to 150.

7. An image bearing dye receptor according to claim 3, characterized in that said support has a water absorption value lower than 30 g/m$^2$.

8. An image bearing dye receptor according to claim 3, characterized in that said dye receiving layer has a thickness of from 1 to 50 μm.

9. An image bearing dye receptor according to claim 3, characterized in that said dye receiving layer has a thickness of from 3 to 30 μm.

10. An image bearing dye receptor according to claim 3, characterized in that said dye accepting polymeric latex comprises particles or micelles having a size range of from 0.01 to 1 μm.

11. An image bearing dye receptor according to claim 3, characterized in that the glass transition temperature of said dye accepting polymeric latex is lower than 50° C.

12. An image bearing dye receptor according to claim 3, characterized in that the glass transition temperature of said dye accepting polymeric latex is in the range of from −10° to 40° C.

13. A image bearing dye transfer receptor according to claim 3, characterized in that the glass transition temperature of said dye accepting polymeric latex is in the range of from −10° to 40° C.

14. A image bearing dye transfer receptor according to claim 3, characterized in that said dye receiving layer has a thickness of from 3 to 30 μm.

15. A image bearing dye transfer receptor according to claim 3, characterized in that said dye accepting polymeric latex comprises particles or micelles having a size range of from 0.01 to 1 μm.

16. A image bearing dye transfer receptor according to claim 3, characterized in that said support is made of paper or polyethylene coated paper.

17. A image bearing dye transfer receptor according to claim 3, characterized in that said support is made of polyester or white pigmented polyester.

18. A image bearing dye transfer receptor according to claim 3, characterized in that said support has a roughness value (Ra) of from 20 to 150.

19. A image bearing dye transfer receptor according to claim 3, characterized in that said support has a water absorption value lower than 30 g/m$^2$.

20. A image bearing dye transfer receptor according to claim 3, characterized in that said support has a thickness of from 100 to 200 μm.

21. A image bearing dye transfer receptor according to claim 3, characterized in that said polymeric latex is prepared by emulsion polymerization.

22. A image bearing dye transfer receptor sheet according to claim 3, characterized in that said polyurethane latex comprises a polyurethane compound derived from a polyfunctional hydroxy compound and a polyfunctional isocyanate.

23. A image bearing dye transfer receptor sheet according to claim 22, characterized in that said polyfunctional hydroxy compound comprises at least one compound selected from the group of polyesters or polyethers having at least two hydroxy end groups and a molecular weight of from 200 to 20,000.

24. A image bearing dye transfer receptor sheet according to claim 22, characterized in that said polyfunctional isocyanate has the following structure $$O{=}C{=}N{-}R{-}N{=}C{=}O$$

wherein R is represented by substituted or unsubstituted alkylene, cycloalkylene, arylene, alkylenebisarylene, arylenebisalkylene.

25. A image bearing dye transfer receptor sheet according to claim 22, characterized in that said polyurethane latex comprises repeating units containing positively or negatively charged group.

26. A image bearing dye transfer receptor according to claim 3, characterized in that said polyvinylacetoversatate latex comprises an amount of vinylacetate of from 50% to 70% by weight and an amount of vinylversatate of from 50% to 30% by weight.

27. A image bearing dye transfer receptor according to claim 3, characterized in that said vinylversatate is an ester of vinylic alcohol with carboxylic acids represented by the following formula:

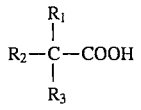

wherein $R_1$, $R_2$ and $R_3$ are alkyl groups of from 1 to 9 carbon atoms and the sum of the carbon atoms thereof is of from 8 to 14.

28. A image bearing dye transfer receptor according to claim 3, characterized in that said styrene-acrylic polymeric latex is represented by the following empiric formula:

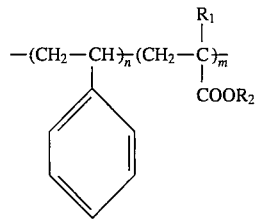

wherein n and m represent the molar percent of the styrene group component and the acrylic group component, respectively, n is at least 50 and m is 100-n, $R_1$ is H or methyl, and $R_2$ is independentely OH or a monovalent organic group.

29. A image bearing dye transfer receptor according to claim 3, characterized in that an intermediate layer is present between the support and said receiving layer.

* * * * *